US008336729B2

(12) United States Patent
Kelly et al.

(10) Patent No.: US 8,336,729 B2
(45) Date of Patent: Dec. 25, 2012

(54) THERMAL BARRIER LINER FOR CONTAINERS

(75) Inventors: Jason Morgan Kelly, Arvada, CO (US); Herbert Bruce Smith, Mississauga (CA); Ray Alan Toms, Golden, CO (US); Daniel Alan Thiemann, Toronto (CA)

(73) Assignee: Millercoors, LLC, Golden, CO (US)

( * ) Notice: Subject to any disclaimer, the term of this patent is extended or adjusted under 35 U.S.C. 154(b) by 541 days.

(21) Appl. No.: 12/249,356

(22) Filed: Oct. 10, 2008

(65) Prior Publication Data

US 2009/0095758 A1 Apr. 16, 2009

Related U.S. Application Data

(60) Provisional application No. 60/980,127, filed on Oct. 15, 2007.

(51) Int. Cl.
*B65D 1/40* (2006.01)
*B65D 81/38* (2006.01)
*A47J 41/00* (2006.01)

(52) U.S. Cl. ..... 220/592.16; 220/62.12; 220/62.22; 220/592.17; 220/592.2; 220/592.25; 220/592.26; 62/457.3; 62/457.4

(58) Field of Classification Search ..... 220/62.12, 220/62.22, 592.16, 592.17, 592.2, 592.25, 220/592.26; 62/457.3, 457.4; 428/34.1, 428/34.4, 35.7–35.9, 36.4–36.8, 320.2, 321.1, 428/323, 327, 402–407

See application file for complete search history.

(56) References Cited

U.S. PATENT DOCUMENTS

| | | | |
|---|---|---|---|
| 2,652,148 | A | 9/1953 | Pfeifer |
| 3,494,142 | A | 2/1970 | Beck |
| 3,525,236 | A | 8/1970 | Solhkhah |
| 3,760,972 | A | 9/1973 | McKirnan |
| 3,852,975 | A | 12/1974 | Beck |
| 3,913,770 | A | 10/1975 | Tarro |
| 4,554,189 | A | 11/1985 | Marshall |

(Continued)

FOREIGN PATENT DOCUMENTS

EP 0931998 7/1999

(Continued)

OTHER PUBLICATIONS

U.S. Appl. No. 12/249,431, filed Oct. 10, 2008, Kelly, et al.

(Continued)

*Primary Examiner* — Anthony Stashick
*Assistant Examiner* — Madison L Poos
(74) *Attorney, Agent, or Firm* — Sheridan Ross P.C.

(57) ABSTRACT

A thermal barrier liner is preferably spray coated onto the internal surface of a container. The liner is provided in embodiments including a closed cell substrate, a base layer having gas or liquid filled microcapsules, a base layer having microencapsulated solid-liquid phase change material, or combinations thereof. For the closed cell substrate embodiment, when the liner is under pressure within the container prior to the container being opened, the liner maintains a minimum thickness. When the container is opened and as pressure is released within the container, the liner expands to achieve equilibrium. The liner can be supplemented with a foaming agent to create cellular structures. Voids created by the microcapsules enhance the thermal barrier characteristics of the liner. The phase change material changes phase from a solid to a liquid state upon absorbing heat.

2 Claims, 4 Drawing Sheets

U.S. PATENT DOCUMENTS

| | | | | |
|---|---|---|---|---|
| 4,628,703 | A | 12/1986 | Kim | |
| 4,671,406 | A | 6/1987 | Baer | |
| 4,736,599 | A | 4/1988 | Siegel | |
| 4,761,314 | A | 8/1988 | Marshall | |
| 4,784,678 | A | 11/1988 | Rudick et al. | |
| 4,802,343 | A | 2/1989 | Rudick et al. | |
| 4,982,722 | A | 1/1991 | Wyatt | |
| 5,168,708 | A | 12/1992 | Siegel | |
| 5,499,460 | A | 3/1996 | Bryant et al. | |
| 5,520,103 | A | 5/1996 | Zielinski et al. | |
| 5,543,186 | A | 8/1996 | Andersen et al. | |
| 5,637,389 | A | 6/1997 | Colvin et al. | |
| 5,718,352 | A | 2/1998 | Diekhoff et al. | |
| 5,762,230 | A | 6/1998 | Policappelli | |
| 5,928,741 | A | 7/1999 | Andersen et al. | |
| 5,952,068 | A | 9/1999 | Neale et al. | |
| 6,065,634 | A | 5/2000 | Brifcani et al. | |
| 6,103,280 | A | 8/2000 | Molzahn et al. | |
| 6,109,006 | A | 8/2000 | Hutchinson | |
| 6,141,970 | A | 11/2000 | Molzahn et al. | |
| 6,151,911 | A | 11/2000 | Dando et al. | |
| 6,173,579 | B1 | 1/2001 | Davidson | |
| 6,341,491 | B1 | 1/2002 | Paine et al. | |
| 6,415,940 | B1 | 7/2002 | Brabson, II | |
| 6,419,108 | B1 | 7/2002 | Toida et al. | |
| 6,422,024 | B1 | 7/2002 | Foye | |
| 6,474,498 | B1 | 11/2002 | Markham | |
| 6,551,638 | B1 | 4/2003 | Dodd et al. | |
| 6,829,902 | B1 | 12/2004 | Claydon | |
| 6,852,381 | B2 | 2/2005 | Debraal et al. | |
| 7,074,466 | B2 | 7/2006 | DeBraal et al. | |
| 7,124,604 | B2 | 10/2006 | Taylor et al. | |
| 7,176,426 | B2 | 2/2007 | Ramirez | |
| 7,431,174 | B2 | 10/2008 | Thissen | |
| 7,802,446 | B2 | 9/2010 | Overgaard | |
| 2002/0150657 | A1 | 10/2002 | Farr et al. | |
| 2002/0164474 | A1 | 11/2002 | Buckley | |
| 2004/0105923 | A1 | 6/2004 | O'Connell | |
| 2004/0109928 | A1 | 6/2004 | O'Connell | |
| 2004/0255787 | A1 | 12/2004 | Lassota et al. | |
| 2005/0147778 | A1 | 7/2005 | Tai et al. | |
| 2005/0196629 | A1 | 9/2005 | Bariatinsky et al. | |
| 2005/0199057 | A1 | 9/2005 | Hadala | |
| 2005/0258250 | A1 | 11/2005 | Melick et al. | |
| 2006/0038293 | A1 | 2/2006 | Rueger et al. | |
| 2006/0054622 | A1 | 3/2006 | Agnello | |
| 2006/0063000 | A1* | 3/2006 | Tokumura et al. | 428/402.2 |
| 2006/0073298 | A1 | 4/2006 | Hutchinson et al. | |
| 2006/0086745 | A1 | 4/2006 | Morrison | |
| 2006/0147696 | A1 | 7/2006 | Crowley | |
| 2006/0153956 | A1 | 7/2006 | Ullmann | |
| 2006/0156756 | A1 | 7/2006 | Becke | |
| 2006/0182165 | A1 | 8/2006 | Tapelt-Glaser | |
| 2006/0182372 | A1 | 8/2006 | Fadal et al. | |
| 2006/0185372 | A1 | 8/2006 | Conde Hinojosa | |
| 2006/0186125 | A1 | 8/2006 | Tew | |
| 2006/0249949 | A1 | 11/2006 | Fortune | |
| 2006/0280843 | A1 | 12/2006 | Jager et al. | |
| 2007/0000484 | A1* | 1/2007 | Magill et al. | 126/263.02 |
| 2007/0059837 | A1 | 3/2007 | Heilmann et al. | |
| 2007/0071680 | A1 | 3/2007 | Ribi | |
| 2007/0138289 | A1 | 6/2007 | Melick et al. | |
| 2007/0212501 | A1 | 9/2007 | Wolfe et al. | |
| 2008/0043804 | A1 | 2/2008 | Goldsmith et al. | |
| 2008/0121728 | A1 | 5/2008 | Rodriguez | |
| 2008/0271476 | A1 | 11/2008 | Langguth | |
| 2009/0305397 | A1 | 12/2009 | Dodgson et al. | |

FOREIGN PATENT DOCUMENTS

| | | |
|---|---|---|
| EP | 1780147 | 5/2007 |
| GB | 2347202 | 8/2000 |
| GB | 2365106 | 2/2002 |
| GB | 2370629 | 7/2002 |
| JP | 2007-090071 | 4/2007 |
| WO | WO 95/04709 | 2/1995 |
| WO | WO 97/24968 | 7/1997 |
| WO | WO 2004/022435 | 3/2004 |
| WO | WO 2004/037888 | 5/2004 |
| WO | WO 2005/102668 | 11/2005 |

OTHER PUBLICATIONS

U.S. Appl. No. 12/251,140, filed Oct. 14, 2008, Kelly, et al.

"Phase Change Material", Answers.com (Technology), available at http://www.answers.com/topic/phase-change-material-1?cat=technology, printed on Aug. 29, 2007, pp. 1-2.

"Encapsulated Phase Change Materials", microtek Laboratories, Inc., available at http://www.microteklabs.com/phasechange.html, printed on Aug. 29, 2007, p. 1.

"Micro PCM's", microtek Laboratories, Inc., available at http://www.microteklabs.com/micropcm.html, printed on Aug. 29, 2007, p. 1.

"n-Paraffin Technical Data Sheet (Complex Normal Paraffin)", microtek Laboratories, Inc., available at http://www.microteklabs.com/table.html, printed on Aug. 29, 2007, p. 1.

International Search Report for International (PCT) Patent Application No. PCT/US08/79686, mailed Dec. 12, 2008.

Written Opinion for International (PCT) Patent Application No. PCT/US08/79686, mailed Dec. 12, 2008.

International Preliminary Report on Patentability for International (PCT) Patent Application No. PCT/US08/79686, mailed Apr. 29, 2010.

U.S. Appl. No. 13/042,112, filed Mar. 7, 2011, Kelly.

Heilman, "Camera Phone Based Indicator," Research and Development Activities in Printed Intelligence, H. Kopola, ed., 2009, VTT Technical Research Center of Finland, pp. 26-27, available at http://130.188.4.36/files/download/scientific_reports/cpi_09_review.pdf#p.=27.

* cited by examiner

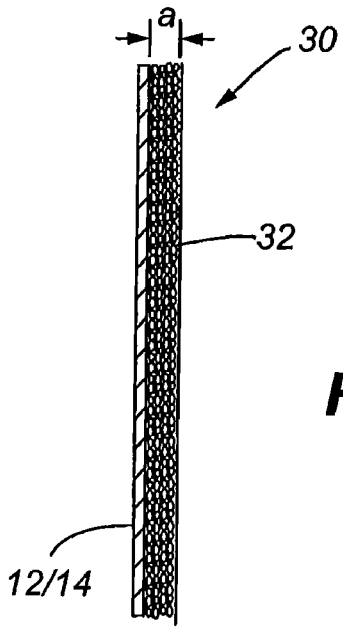
Fig. 2
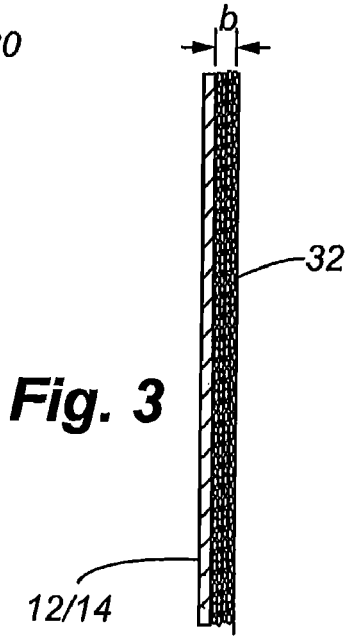
Fig. 3
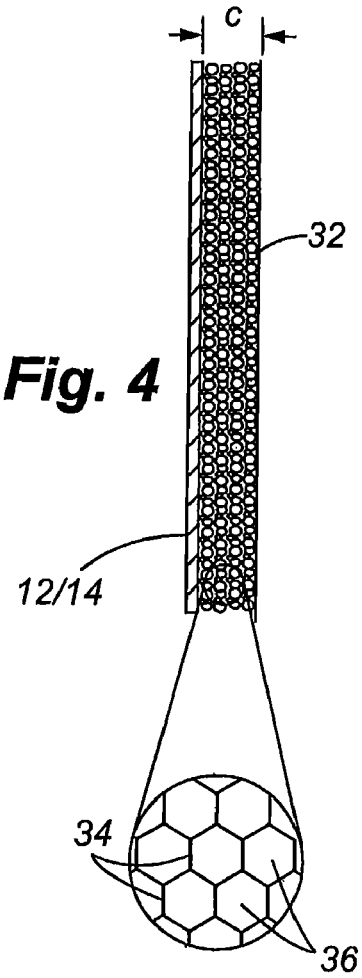
Fig. 4
Fig. 4A
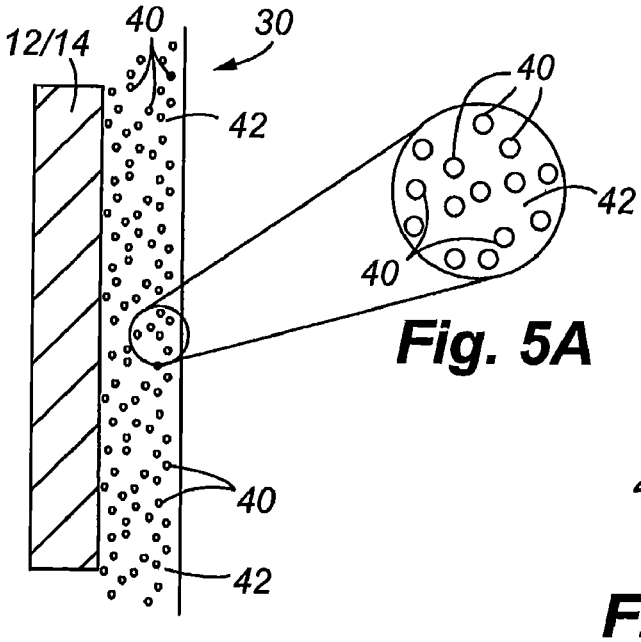
Fig. 5
Fig. 5A
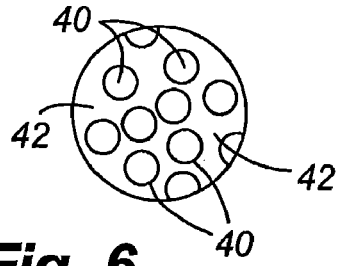
Fig. 6

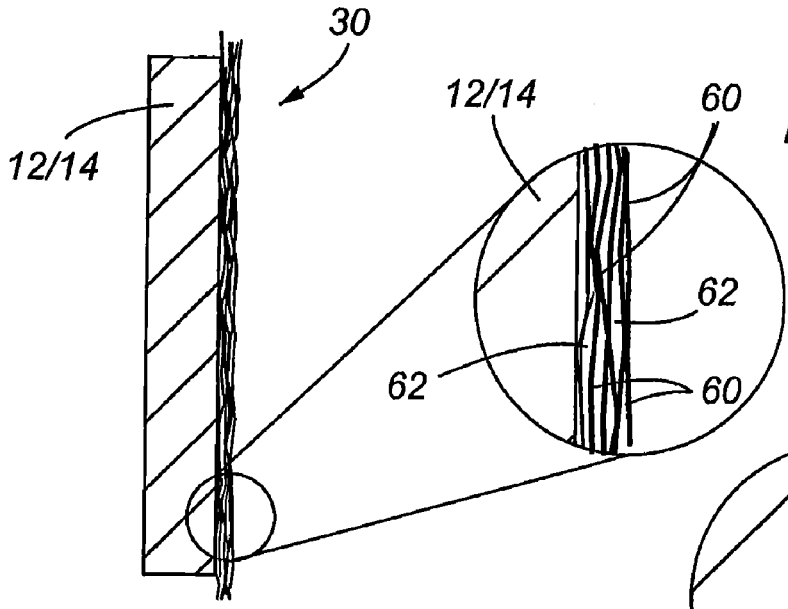
Fig. 9A
Fig. 9
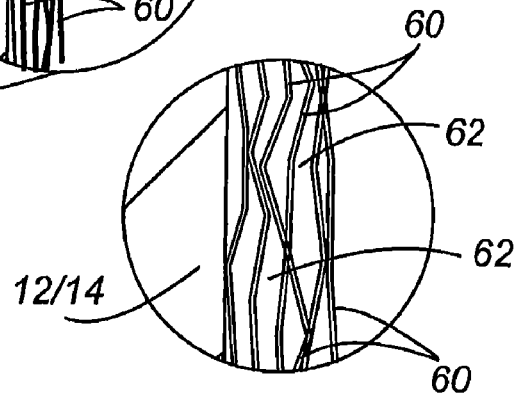
Fig. 10
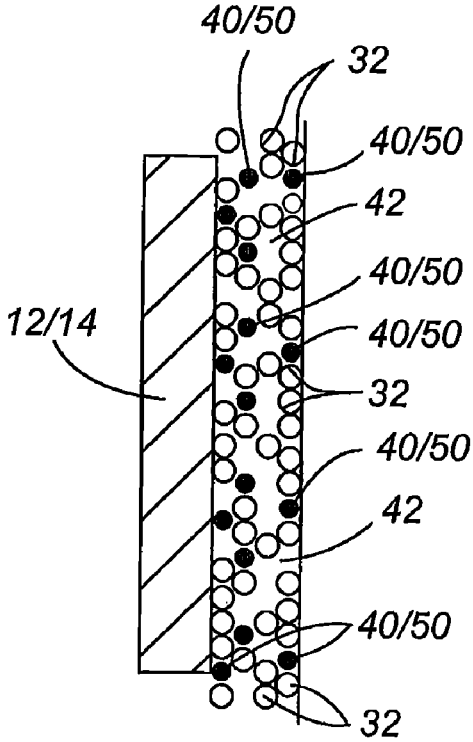
Fig. 11
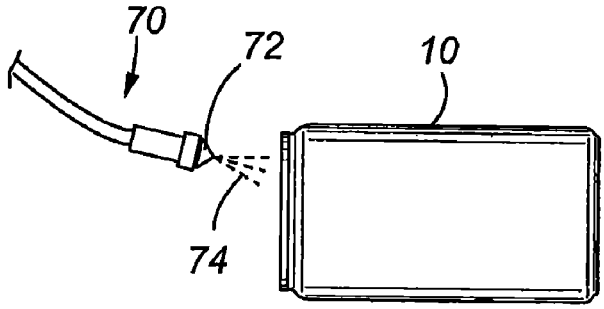
Fig. 12

THERMAL BARRIER LINER FOR CONTAINERS

CROSS REFERENCE TO RELATED APPLICATIONS

Priority is claimed from U.S. Provisional Patent Application No. 60/980,127 filed on Oct. 15, 2007 and entitled, "THERMAL BARRIER LINER FOR CONTAINERS", the disclosure of which is incorporated herein by reference in its entirety.

FIELD OF THE INVENTION

The present invention relates to a thermal barrier liner for containers, and more particularly, to a thermal barrier liner formed on the inner surface of the container and a method of applying the liner by spray coating.

BACKGROUND OF THE INVENTION

Portable beverage containers are used to hold many types of beverages to include carbonated soft drinks, fruit drinks, and beer. It is well known to provide a protective internal liner for those containers made of metal such as aluminum or steel to help preserve the beverage within the container by preventing undesirable chemical reactions that would otherwise take place over time by direct contact of the beverage with the metallic container. For containers made of plastic, there is typically no internal liner provided because the plastic material is inherently non-reactive with respect to most types of beverages.

Many beverages are preferably consumed at relatively cold temperatures, for example, between about 36° F. and 50° F. For carbonated soft drinks and beer, consumers typically prefer these beverages to be chilled prior to consumption. Traditional chilling or cooling techniques include placing the containers in a chilled environment such as a refrigerator or cooler, and then serving the beverage once the beverage has reached a desired chilled temperature.

When the beverage is removed from the chilled environment, the beverage begins to quickly warm due to a combination of external heat sources including ambient heat of the surrounding environment, contact with warm surfaces such as the consumer's hand or the surface on which the container is placed, as well as radiant heat from the sun or other light sources. Heat transfer takes place through the walls, base, and top of the container to the beverage. Without some means provided for insulating the container, the beverage so quickly warms that, in many circumstances, it becomes undesirable or unfit for consumption.

There are a number of inventions that have been developed for purposes of insulating a beverage within the container such that it is maintained at a desired temperature prior to consumption. For example, it is well known to provide external thermal barriers, such as an insulating sleeve that is applied over the exterior sidewall of the container. It is also known to provide an insulated label on the sidewall of the container. There are a number of disadvantages to these traditional methods of insulating beverages. An insulating label/sleeve only covers the container sidewall, therefore leaving the bottom of the container exposed. For insulated labels, they are typically much thicker than a non-insulated label and, therefore, standard packaging line may have to be substantially modified to accommodate these special labels. For insulating sleeves, these require the consumer to maintain a separate component to maintain the beverage at a desired cold temperature.

Some efforts have been made to provide an internal insulating liner for containers. One example is disclosed in U.S. Pat. No. 6,474,498. This reference discloses a thermally insulated container for canned beverages including a lining formed from a plastics material. The preferred embodiments suggest using a plastic closed cell material to include closed cell material similar to bubble wrap. The liner is intended to be placed into the container as by a slidable fit within the container so as to be in contact with the cylindrical inner surface of the container wall. The lining member may include an adherent surface allowing the lining to adhere to the internal wall of the container. In an alternative embodiment, this reference discloses a closed cell material that can be provided as a layer on the interior surface of the metal container in addition to or in place of a conventional lacquered coating applied to the interior surface of the container.

U.S. Patent Application Publication No. 2006-0073298 discloses a multi-layer inner liner provided for a container and an extrusion method for a beverage container. The method contemplates blow molding the inner liner by co-extrusion of a first inner layer of a thermoplastics material and a second inner layer made of a foam material having insulating properties. The inner layer of foam is further disclosed as having micro-spheres that expand during the blow-molding process.

U.S. Patent Application Publication No. 2006-0054622 discloses an insulated beverage container having an inner liner that adheres to the inside of the container. The inner liner is made from a crystalline ceramic material.

While the foregoing references may be adequate for their intended purpose, there is still a need for an internal thermal barrier to maintain a beverage at a desired temperature wherein the thermal barrier can be incorporated within a liner applied using standard packaging machinery. There is also a need to provide a thermal barrier liner for a container wherein the barrier liner can be expanded to cover not only the container sidewall, but also the bottom of the container.

SUMMARY OF THE INVENTION

It is one object of the invention to provide a thermally insulated beverage container that can effectively and safely keep beverages at a desired temperature during consumption of the beverage.

It is yet another object of the present invention to provide a thermally insulated beverage container by providing a thermal barrier liner utilizing a single material that exhibits specific common desirable properties resulting in creation of an insulated thermal barrier.

It is yet another object of the present invention to provide a unique combination of materials that, when combined, exhibit desirable thermal barrier properties.

It is yet another object of the present invention to provide a method of installing a thermal barrier, such as a spray coated liner.

It is yet another object of the present invention to provide a thermal barrier that may be applied to different types of beverage containers, such as those made from metal or made from plastic.

It is yet another object of the present invention to provide a thermally insulated beverage container that can be introduced into existing beverage manufacturing, distribution, and sales sectors without requiring significant alterations in manufacturing machinery or processes.

In accordance with the present invention, a thermally insulated beverage container is provided having a thermal barrier liner formed on the inner surface of the container. The container of the present invention may include any known beverage container, such as those made from aluminum or steel that hold beverages such as beer or carbonated soft drinks. The container of the present invention may further include known plastic containers, such as PET bottles or cans.

In a first embodiment of the present invention, the thermal barrier liner may include use of a single material having a cell structure comprising a plurality of voids or pockets and wherein the liner covers the interior surface of the container to include the container sidewall and base of the container. In this embodiment, the liner may also be referred to as a closed cell substrate layer or foam layer. The material used for the barrier liner in this embodiment has a stretchable or elastic capability such that the voids may increase in physical size without rupturing. The particular liner material and manner of applying the liner can be selected such that the cell sizes create a thermal barrier liner of a desired thickness when the container is opened. The thickness of the barrier liner as well as the composition of the barrier liner in terms of the amount of void spaces within the liner can also be adjusted to optimize the thermal barrier liner for purposes of insulating the beverage. The thermal barrier liner may be made from a cavitated monolayer film substrate containing gas permeable closed cells.

In other embodiments of the present invention, the thermal barrier liner includes a base material containing encapsulated gases or phase change materials. The encapsulated gases or phase change materials are dispersed throughout the base layer. The base layer is monolithic and the liner is preferably applied by spraying as discussed further below.

In another embodiment of the present invention, the thermal barrier liner includes a combination of materials that, when combined, exhibit thermal barrier properties. This embodiment may be referred to as a composite liner including a combination of: (i) a cell structure comprising a plurality of voids or pockets; (ii) encapsulated gases; and/or (iii) encapsulated phase change materials. In this embodiment, the base material is also preferably applied by spray coating the interior of the container. One or more spray coating layers can be applied in a single or multi stage spray application. In yet another embodiment of the present invention, a thermal barrier liner may be provided in the form of a multi-layer coating construction wherein voids or gas pockets are found between the layers thereby providing an effective thermal barrier. In this embodiment, a co-extrusion lamination process can produce the multi-layer coating where portions of adjacent layers are sealed to one another while other portions are not sealed thus creating the gas pockets or void areas between the layers.

In yet another aspect of the present invention, a method is provided for applying the thermal barrier liner to the interior surface of a beverage container utilizing a spray coating technique and wherein temperature, viscosity, and atomization of the coating may be varied to create a desired thermal barrier liner.

The thermal barrier liner in the first embodiment of the present invention is gas permeable thus having the ability to equilibrate with ambient pressure conditions. More specifically, during the application of the liner to the container, the voids or pockets formed in the liner will contain gas of the surrounding environment, and the ambient pressure will determine the void sizes. After the container has been filled and sealed, the interior of the container develops a higher pressure in which the void areas further fill with gas contained in the container, such as carbon dioxide or nitrogen. This gas can reside either in the headspace or can be gas dissolved in the beverage. Since the container is under pressure, the voids may decrease in size as compared to the size of the voids under ambient pressure conditions, however, the voids will contain a greater amount of gas due to the higher pressure conditions in which equilibrium is reached and pressure across the liner is equal. The voids fill with the gas(es) over a relatively short period of time due to the gas permeable nature of the liner material.

Once the container is opened, the thermal barrier liner transitions to equilibrium with ambient pressure wherein the pressurized gas contained within the voids causes an immediate expansion of the size of the voids. The increased size of the voids creates a thickened liner that is an effective thermal barrier liner to maintain beverage at a desired temperature.

It is also contemplated within the present invention that the thermal barrier liner can also serve as the standard protective liner used to prevent direct contact between the beverage and the metallic internal surface of the container. It is also contemplated that the thermal barrier liner can also be directly applied over a standard protective liner, thus not replacing the standard liner.

Other features and advantages of the present invention will become apparent from a review of the following detailed description, taken in conjunction with a review of the drawings.

BRIEF DESCRIPTION OF THE DRAWINGS

FIG. 2 is an enlarged fragmentary cross section view of the thermal barrier liner of the present invention in a first embodiment characterized by a closed cell substrate layer or foam layer;

FIG. 3 is another enlarged fragmentary cross section of the embodiment of FIG. 2 showing the closed cell substrate layer after the container has been sealed and pressurized;

FIG. 4 is another enlarged fragmentary cross section view of the first embodiment after the container has been opened resulting in expansion of the liner;

FIG. 4A is a greatly enlarged view of a portion of FIG. 4 showing the structure of the substrate layer after the container has been opened;

FIG. 5 is an enlarged fragmentary cross section of a barrier liner in another embodiment of the present invention comprising microcapsules containing encapsulated gas or liquid embedded in a base liner material sealed and pressurized;

FIG. 5A is a greatly enlarged view of a portion of FIG. 5 showing the barrier liner and the gas or liquid filled microcapsules;

FIG. 6 is a greatly enlarged view of the portion of FIG. 5 when liquid filled microcapsules are used and undergo a phase change to a gas upon warming and wherein the microcapsules expand in the gaseous state;

FIG. 9 is an enlarged fragmentary cross section view of another embodiment of the present invention illustrating a thermal barrier liner constructed of a multi-layer configuration and illustrating the container when sealed and pressurized;

FIG. 9A is a greatly enlarged view of the embodiment of FIG. 9 showing the multi-layer configuration when the container is sealed and pressurized;

FIG. 10 is another greatly enlarged view of the embodiment of FIG. 9 illustrating the container after it has been opened and expansion in thickness of the liner;

FIG. 11 illustrates yet another embodiment of the present invention in the form of a composite thermal barrier liner including a combination of features of the prior embodiments including a closed cell substrate, and encapsulated gas and/or encapsulated phase change material set within a base liner; and FIG. 12 is a schematic view of equipment used to apply the thermal barrier liner of the present invention as by spray coating.

DETAILED DESCRIPTION

Figure 1:
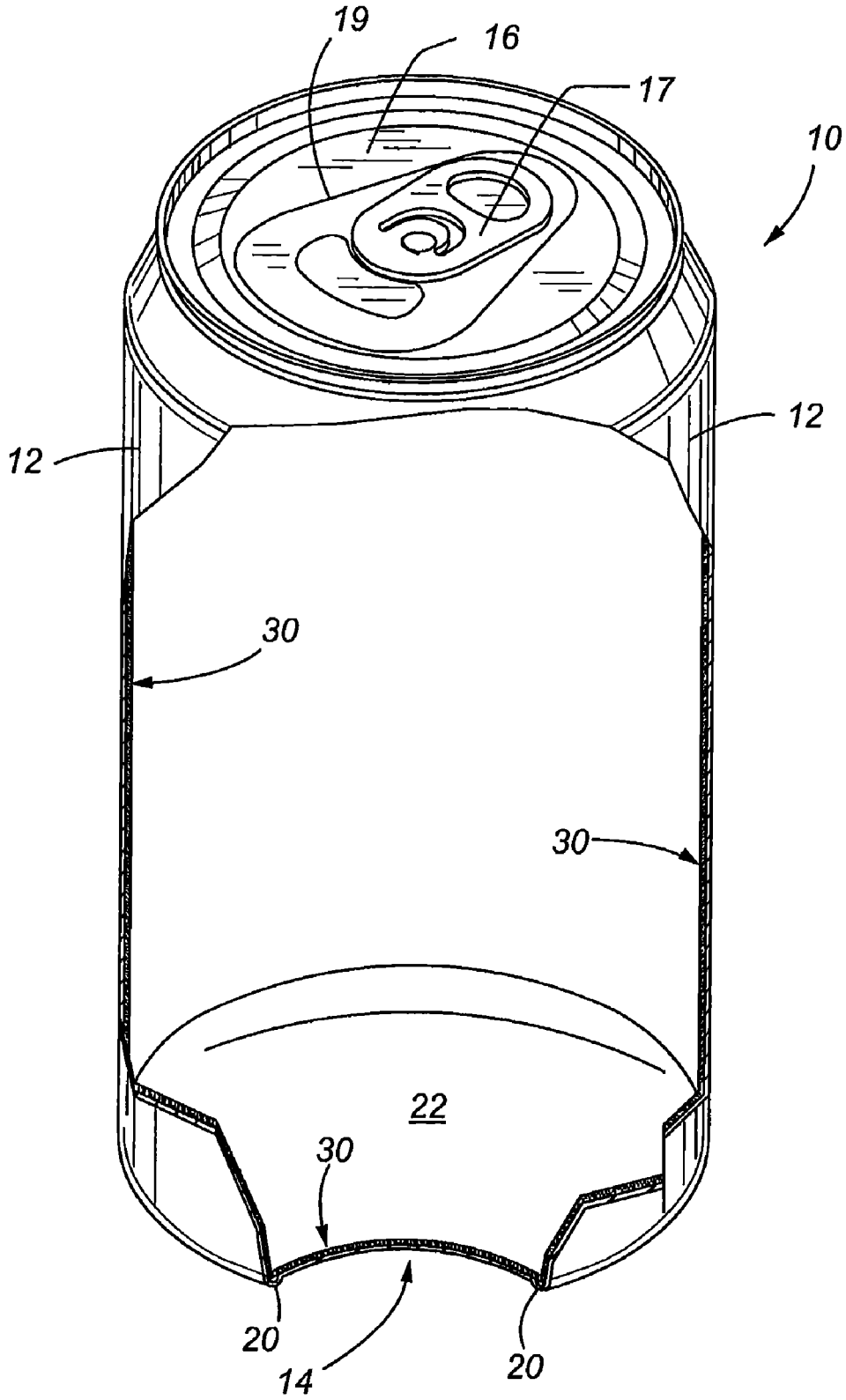
FIG. 1 is a fragmentary perspective view of a beverage container incorporating a thermal barrier liner of the present invention.

With reference to the drawings, FIG. 1 shows a beverage container 10, particularly suited for beverages such as beer or carbonated soft drinks, fruit drinks, and like. The container is illustrated as a conventional beverage can having a sidewall or body 12, a base 14, and an openable top 16. The openable top 16 may include a closure mechanism, such as a pull-tab 17. The sidewall or body of the container is constructed of conventional materials such as aluminum or steel. The openable closure mechanism 17 is also preferably aluminum or steel and may include the pull-tab 17 that contacts a scored area 19 on the top 16. Activation of the pull-tab 17 breaks the scored area 19 creating an opening or mouth to provide access to the beverage inside the container. As also shown in FIG. 1, the conventional container may include the bottom or base 14 having an annular lip 20 and a dome shaped panel 22.

In accordance with a first embodiment of the present invention, a thermal barrier liner 30 is provided as shown in FIGS. 1-4. The thermal barrier liner in this first embodiment comprises a gas permeable closed cell substrate 32. The substrate 32 is secured to the interior surface of the container. The gas permeable closed cell substrate includes a pattern of cells 34 defining a plurality of voids, gaps, or open spaces 36 thereby providing the appearance of a foam layer. FIG. 2 illustrates the substrate 32 after the substrate has been applied to the interior surface of the container. As discussed further below, the substrate 32 may be applied by spray coating. The voids or gaps may be of an irregular pattern and the voids or gaps may be of different sizes and shapes. In one aspect of the first embodiment, the thermal barrier liner material may be made from a homogenous material. In another aspect of the first embodiment, the thermal barrier liner may include a combination of materials. In either case, the liner is gas permeable and the cells 34 have walls that are elastic/elastomeric such that the overall size of each of the voids/gaps 36 can change according to ambient pressure conditions.

The arrangement and size of the voids/gaps 36 may be a result of either how the liner 30 is applied, and/or may be created during a curing process wherein the voids/gaps form over a period of time. The void areas may be randomly dispersed and randomly sized. However, depending upon the material used as the liner, a more orderly cellular pattern may result. The percentage of void or open cell space volume can range between about 10 to about 95 percent of the overall volume of the thermal barrier liner.

One important attribute of the substrate 32 is that it be gas permeable such that when placed under pressure, the substrate will equilibrate resulting in a substantially uniform distribution of gas within the voids 36. Furthermore, when pressure is reduced, the substrate should have the capability to expand such that the cell walls 34 do not burst, tear, or otherwise degrade and, rather, will maintain an inflated state for a period of time thus creating an effective thermal barrier liner realized by the increased volume of the substrate 32.

It has been found through testing that some existing container liner materials have the capability to be formed into foamed substrates and are elastic such that the substrate maintains integrity among various pressure ranges. However, in order to create the closed cell substrate configuration and necessary gas permeability, foaming agents are added to the liner materials. Two known liner materials may include Valspar 9823-001, or ICI 640-C692CLS. When combined with the appropriate foaming agents, these liner materials may be applied to the interior surface of the container to form a thermal barrier liner having a gas permeable closed cell substrate configuration that is able to equilibrate at working pressure changes.

Referring to FIG. 3, this figure represents how the barrier liner 30 appears when the container has been sealed and pressurized. As shown, the overall thickness of the barrier liner reduces in response to the increased internal pressure within the container. Accordingly, FIG. 2 shows a thickness "a" of the liner that may be somewhat larger than the thickness "b" of the liner when the container is sealed and pressurized. For carbonated beverages, carbon dioxide is the primary gas that fills the container under pressure. Accordingly, the substrate must be permeable to allow passage of the carbon dioxide if used with such carbonated beverages. Within a period of time, the thermal barrier liner will allow passage of the pressurized gas within the container such that the substrate is fully entrained with the pressurized gas. Optionally, liquid nitrogen may be added to the beverage just before sealing to assist in pressure development. In most container filling processes, the end or cap of the container is not attached to the body of the container until the beverage has been added to the container. When the end or cap is attached, a seal is created thus preventing liquid or gas from escaping. Pressure within the container will increase due to a number of factors such as carbonization within the beverage, any added liquid such as nitrogen that will transition to a gas phase, and pasteurization of the beverage by heat treatment. As the thermal barrier liner becomes entrained with the gas, the liner will de-compress as it equilibrates with the internal gas pressure Some reduction in the area of the headspace of the container may occur by thickening of the liner due to entrainment of the pressurized gas into the liner after the container has been sealed and pressurized. However, normal levels of container pressurization do not have to be significantly altered to account for presence of the liner since the liner even in its fully gas entrained state after sealing and pressurization takes up a minimum volume within the container.

The thermal barrier liner is preferably of a thickness under ambient pressure conditions such that it does not unduly displace the typical amount of the beverage within the container. Thus when the barrier liner expands under ambient pressure conditions, the beverage in the container will not be forced through the opening in the container.

Referring to FIG. 4, this figure represents the point in time when the container has been opened. In response to the reduction in ambient pressure, the cells 34 expand in size to reach equilibrium. Thus, the thickness "c" of the liner is greater than both the thicknesses "a" and "b". The cells maintain this expanded state for a period of time thus providing an effective thermal barrier liner to maintain the beverage at a desired temperature. Typically, the pressure within the container prior to opening is 10 to 35 psi, depending upon carbon dioxide and nitrogen levels and temperature of the beverage. By expanding the overall thickness of the barrier liner 30, and without otherwise altering the dimensions of the container or any other parameters, the thermal barrier liner is enhanced simply by the ambient pressure changes between the unopened and opened container.

An added benefit with respect to first embodiment is that when the container is being chilled (when unopened) fast chilling of the beverage may take place since the thermal barrier liner is in its more compressed or thin state, thereby allowing rapid heat transfer away from the container without having to overcome a relatively thickened insulating member.

The permeability of the thermal barrier liner is such that gas is allowed to permeate through the cell walls over a period when under pressure to reach equilibrium, for example, a few hours, but the cell walls are not so permeable that immediate deflation takes place when ambient pressure is reduced. Therefore, the thermal barrier liner will maintain a full thickness for at least a period of time in which a consumer would normally consume the beverage. It is contemplated that it may take up to twenty-four hours for pressurized gas within the container when the container is sealed to permeate through the thermal barrier liner but when the container is opened, it will take at least one hour before the thermal barrier liner reaches equilibrium with the reduced pressure of the environment. Thus, a full, thickened barrier liner is maintained during the time period in which a consumer normally consumes the beverage.

FIGS. 5, 5A and 6 illustrate yet another embodiment of the present invention in the form of a thermal barrier liner 30 comprising a layer of base material 42 interspersed with an additive component 40 such as gas or liquid filled microcapsules. The base material 42 binds to the additive component 40 and ensures a continuous coating of the interior surface of the container.

The additive component 40 can either be a majority component or minority component by volume as compared to the base layer 42. As mentioned further below with respect to a method of applying the thermal barrier liner, the base material 42 and additive component 40 may be premixed into a single slurry and spray coated onto the interior surface of the container.

Preferably, the additive component is dispersed randomly throughout the base layer. Once the interior of the container is coated with the barrier liner, it is cured to optimize the thermal barrier properties. For example, the container can be oven dried to evaporate and otherwise remove any solvents or other substances used with the additive component during application to the container. This curing process can also be used to condition gas filled microcapsules. For example, heat applied to the container during curing can cause a controlled amount of expansion of the gas filled microcapsules so that the barrier liner is placed in a desired state prior to filling of the container.

One example of an additive component that may be used as a microencapsulated gas includes Expancel®. Expancel® is a commercially available product that includes elastic microspheres or microcapsules, roughly ten micrometers in diameter, filled with a small amount of liquid hydrocarbon. When heated within a known temperature range, the hydrocarbon liquid vaporizes to a gas state within the micro-spheres. The shells or casings of the micro-spheres expand as the gas expands within the micro-spheres. In the expanded state, the micro-spheres can expand to a diameter of four times the un-expanded state resulting in a volume increase of approximately forty times larger than the un-expanded size. The micro-spheres can be used either in an unexpanded state or a pre-expanded gaseous state, depending on application capabilities and the elasticity of the base material 42. With respect to use as an insulation material in the present invention, use of pre-expanded spheres for the additive component 40 would create a pattern of voids in the base layer.

As mentioned, the microcapsules create voids in the base layer and thereby enhance the thermal barrier capability of the liner. The size and distribution of the voids created by the gas or liquid filled spheres can be selected to provide the desired level of insulation for the container. A greater concentration of micro spheres will produce more voids. The particular gas or liquid selected can be selected to optimize the desired level of insulation.

In the event that the liner is applied to the interior of the container as by spray coating, one option is to activate the microspheres to their expanded state when the liner is cured. A drying oven can be used to cure the liner and the heat from the oven would result in activation of the microspheres to create the insulating voids.

It is also contemplated that liquid filled micro spheres can be provided so that the liquid changes phase to a gaseous state when the beverage warms during consumption by the consumer. Thus, when the beverage is maintained in its cooled state during storage, the micro-spheres would remain in a liquid state. Referring to FIG. 6, when the container is opened and exposed to the warmer environment, the increase in temperature causes the micro-spheres to transition to a larger diameter as the liquid changes phase to the gas state. Thus, the expansion of the thermal barrier liner in this example is activated by temperature and not by ambient pressure changes. A liquid-gas phase change property for the thermal barrier liner of the present invention may be particularly suited for containers that are not pressurized, such as juice, fruit, or vegetable containers.

For both the first and second embodiments, one acceptable base liner material 42 may include Valspar 9823-001 or ICI 640-C692CLS. Increased curing times may be required depending upon the addition of an additive component which may, therefore, increase the curing time.

Figure 8:
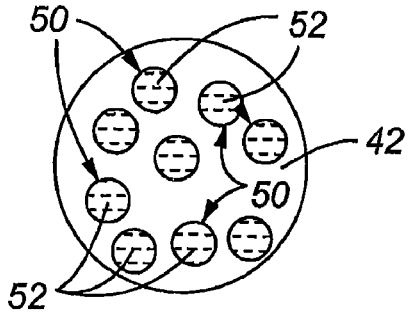
FIG. 8 is another greatly enlarged view of the embodiment of FIG. 7 when the container has been opened and the beverage has warmed to the phase change temperature, showing the phase change material in the microcapsules being in a liquid state after the phase change.
Figure 7:
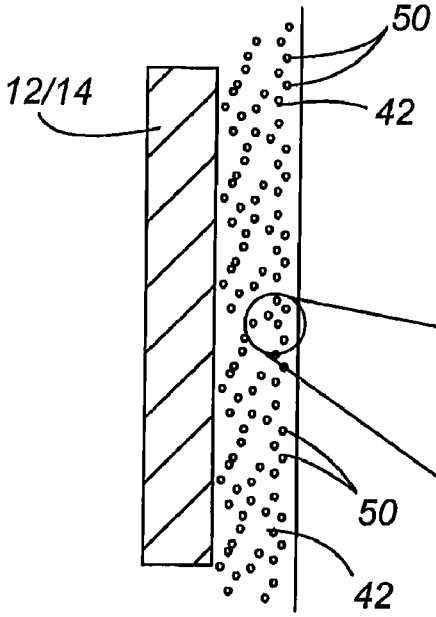
FIG. 7 is an enlarged fragmentary cross section view of a thermal barrier liner in another embodiment of the present invention comprising encapsulated solid phase change materials incorporated within a base liner and showing the thermal barrier liner when the container is sealed and pressurized.
Figure 7A:
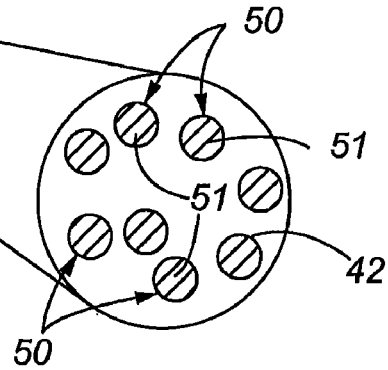
FIG. 7A is a greatly enlarged view of a portion of FIG. 7 showing the barrier liner and the encapsulated solid phase change material within the microcapsules.

Now referring to FIGS. 7, 7A and 8, in yet another embodiment of the present invention, a thermal barrier liner is provided comprising a base layer 42, and an additive component 50 in the form of encapsulated phase change material. The encapsulated phase change material 50 may also be microcapsules that are interspersed as shown within the base layer 42. One example of phase change material that may be used includes paraffinic hydrocarbons. Another phase change material may include hydrated salts. One commercially available type of phase change material may include MPCM-6, a product sold by MicroTek Laboratories, Inc. MPCM-6 is a microencapsulated paraffin wax (specific latent heat of 188.6 J/g) in a polymer shell with a solid to liquid phase change temperature occurring at 6° C. When chilled to below 6° C., the paraffin exists as a solid. As the spheres absorb heat, the encapsulated paraffin rises in temperature until it reaches 6° C. At that temperature, the paraffin continues to absorb heat, but stays at a relatively constant temperature until it has completely transitioned from a solid to a liquid phase. The heat absorbed by the phase change material, also known as latent heat, would otherwise have caused an increase in the temperature of the beverage within the container. The total amount of heat capable of being absorbed by the paraffin wax can be calculated and adjusted by varying the amount of paraffin used within the barrier layer. For example, 25 cc of MPCM-6, which would normally require a minimum liner thickness of one millimeter, absorbs the equivalent heat that would otherwise cause a 5° F. increase in temperature of a 355 cc beverage.

FIGS. 7 and 7A specifically illustrate this third embodiment wherein the container is under pressure and assumedly at a chilled temperature (for example below 6° C.). FIG. 8 shows the container when removed from refrigeration and warmed to a temperature wherein the solid phase change material has transitioned from a solid to liquid state. More specifically, the materials in the microcapsules 50 are shown in FIGS. 7 and 8 as transitioning from a solid state 51 to a liquid state 52.

FIGS. 9, 9A and 10 illustrate yet another preferred embodiment of the present invention. In this embodiment, the thermal barrier liner 30 comprises multiple layers 60 of a lining material wherein voids or gaps 62 exist between each of the layers. The voids or gaps between the layers may be provided in an irregular pattern. Thus, the layers do not lie evenly over one another and the layers extend non-linearly having continuous patterns of bends or curves in the liner material that form the voids or gaps 62. As shown in FIGS. 9 and 9A, when the container is under pressure and unopened, the layers 60 form a more compressed, thinner profile. However, as shown in FIG. 10, when the container is opened and ambient pressure is reduced, the gas trapped in the voids between the layers results in an expansion of the liner, thereby enhancing thermal barrier properties of the liner.

This multi-layer liner can be constructed of multiple layers of the same material, or may be made of dissimilar materials. With respect to a single material used, if the single material is applied at different times with different temperatures or viscosities, voids or gas pockets may be formed between layers. With respect to use of dissimilar materials, void areas between the layers may be formed more as a function of the ability of layers to adhere to one another, among other factors. Unlike conventional liners applied to the interior of containers, it is the intent in the embodiment shown in FIGS. 9 and 10 to apply a multi-layered liner wherein intentional voids or gaps are created between the layers of material such that gases may be trapped between the layers. Thus, as mentioned above, the variation of temperatures, viscosities, as well as use of dissimilar materials can result in the creation of a multi-layered liner having inconsistencies in how the layers adhere to one another. Visually, the liner of this embodiment may appear somewhat wrinkled or may appear as having a roughened surface. These apparent inconsistencies in the liner are a result of the intention to provide gaps or void spaces between the layers of the liner. Thus, this multi-layered liner significantly departs from multi-layered liners, either used internally or externally for containers, wherein the failure to completely adhere one layer to another may be considered a significant defect.

Referring to FIG. 11, a composite thermal barrier liner may be provided by combining one or more of the attributes from the prior embodiments. More specifically, FIG. 11 illustrates a gas permeable closed cell substrate 32 being formed, as well as microencapsulated gas and/or microencapsulated solid-liquid phase change material 40/50 being set within a base layer 42.

Referring to FIG. 12, one method by which the thermal barrier liner may be applied to a container is by spray coating. Accordingly, FIG. 12 illustrates a spray coating device 70 positioned to apply a coating of material to form the thermal barrier liner. The spray coating device 70 may be conventional, as found in many container manufacturing lines. Accordingly, the coating device may include a nozzle 72 that directs an atomized spray 74 that forms the barrier liner 30. The containers can be rotated in the range of the spray 74 in order to ensure a uniform layer is applied to the container. The atomized spray can be pressurized and can also be airless meaning that the liquid spray does not require a pressurized entrained gas to deliver the spray. Since the barrier liner 30 is applied by spray coating, both the sidewalls and interior base of the container may be coated. With respect to the multi-layer embodiment illustrated in FIGS. 9, 9A and 10, a plurality of layers may be applied by separate spray coating steps, for example, a first coat is applied by a first spray coating device, and then additional layers are provided by other spray coating devices incorporated in series within the production line. As mentioned above, various temperatures and materials can be used to create the desired gap/void arrangement between the layers of materials.

Although spray coating the liner has been described as a preferred method of installing the liner, it is also contemplated within the present invention that a number of other manufacturing techniques may be used to incorporate the thermal barrier liner into the present invention. For example, the thermal barrier liner may be pre-made and then mechanically inserted within the container, or the interior liner of the container may be coated by contact with processing equipment that dispenses the thermal barrier liner and adheres or seals the liner to the interior of the container. Additionally, while spray coating may be advantageous for applying the liner to both the interior sidewall and interior surface of the base of the container, application of the liner to the base is optional. Further, while it may be advantageous to not require use of an adhesive to secure the thermal barrier liner to the interior of the container, such as when a spray coating process is used, in some liner installation techniques it may be advantageous to use some amount of adhesive.

With respect to a preferred thickness of the thermal barrier liner, it shall be understood that none of the embodiments are strictly limited to a specific range but it has been found that a liner between about 1.0 mm to 3.0 mm provides adequate insulation without displacing a quantity of the beverage that adversely affects desired headspace within the container. For the first embodiment, the thermal barrier liner can be between about 0.5 mm and 1.5 mm in thickness when the container is sealed and pressurized, and the thermal barrier liner expands to between about 1.0 mm and 3.0 mm mm when the container is opened and exposed to the environment.

For each of the embodiments of the present invention, it shall be understood that the thermal barrier liner 30 may be used as an additional layer applied to the interior surface of the container strictly for purposes of insulation, or may also serve as a combination of a conventional interior liner of the container to prevent undesirable contact between the beverage and the metallic sidewall and base, as well as a thermal insulating barrier. In order to improve adhesion of the liner to the sidewall of the container, a primer layer could be applied prior to applying the liner. Also, in order to create the liner having an adequate thickness, the spray coating may include two separate applications or passes wherein after the first coat or layer is applied, the container is air dried prior to applying the second layer. The container could then be dried/cured to complete the liner application process.

It shall be understood that the thermal barrier liner of the present invention significantly departs from traditional liners used to coat the interior of a container for purposes of preventing spoilage of the beverage in the container. More specifically, conventional liners are formed to create a very smooth, thin, and non-insulative layer. Thus, the thermal barrier liner of the present invention by provision of a closed cell substrate, and/or with micro-encapsulated materials, or a multi-layer liner provides a unique solution for a thermal barrier, yet at the same time still fulfills the need for providing a liner to prevent direct contact of the beverage with the metallic sidewall and base of the container.

As also mentioned above, provision of a gas permeable liner that can equilibrate between different ambient pressures allows creation of a thicker insulative layer once the container is opened. Providing this active or size changing barrier liner also has the benefit of allowing the container to be more easily cooled when unopened, yet allows substantially the same amount of beverage to be maintained in the container since the barrier liner occupies a minimum volume when under pressure or when chilled.

With respect to the embodiment of the present invention providing a multi-layered liner, the structure here is intended to provide voids between layers as opposed to material protective liners in which the intent is primarily to minimize void areas between the layers in order to maximize the bond between the layers. In fact, many can liners require additives therefore improving the wetting or contact area to maximize bonding between the layers. However, with the present invention, the bonding areas between the layers is reduced to the point where a balance can be achieved between a bond strength such that the layers maintain integrity and remain bound to one another, yet gaps or void areas are formed to allow permeation of gas and subsequent expansion thereby creating an effective thermal barrier liner. Some techniques to promote rough and irregular surface bonding between the layers may include use of high viscosity materials, cold application temperatures, and use of different materials between layers that are not fully miscible.

While the preferred embodiments of the present invention have been shown specifically with respect to a traditional aluminum or steel container, it shall be understood that the thermal barrier liners of the present invention can be incorporated within any type of container to include plastic containers such as PET bottles, or conventional aluminum or steel cans used to contain fruits, vegetables, soups, meat or other products.

Because the thermal barrier liner of the present invention is preferably formed with a liner material having some adhesive characteristic, it is unnecessary to provide a separate adhesive coating or layer in order to secure the thermal barrier liner to the interior surface of the container. Furthermore, as discussed above, the thermal barrier liner of the present invention may be used in addition to or to replace the traditional can liner used for purposes of preventing direct contact between the beverage and the interior surface of the container.

While the present invention has been discussed for use in keeping beverages cool, it shall also be understood that the present invention can also be used to thermally insulate a beverage intended to be served at room temperature or warmer. For the first embodiment of the present invention incorporating the closed cell substrate that is capable of thermally insulating a container by only changes in pressure, this embodiment can certainly be used for those beverages that are intended to be served at room temperature or warmer.

The automatic activation of the thermal barrier liner under variable pressure or temperature conditions makes the thermal barrier liner ideal in those commercial applications where the beverages may be stored under pressure, such as the case for carbonated soft drinks and beer.

Because the thermal barrier liner of the present invention may be applied using manufacturing techniques such as spray coating, it is unnecessary to significantly alter or otherwise modify known beverage packaging machinery or processes.

While the present invention has been described with respect to various preferred embodiments, it shall be understood that various other changes and modifications to the invention may be made, commensurate with the scope of the claims appended hereto.

What is claimed is:

1. An insulated container comprising:

a sidewall, a base connected to the sidewall, and a top forming an upper portion of the container;

a composite thermal barrier liner applied to an interior surface of said sidewall, said thermal barrier liner comprising a base material and a plurality of microcapsules containing phase change material mixed therein, said microcapsules being dispersed in said base material, wherein said microcapsules absorb heat upon a temperature increase within an interior of the container and the phase change material changes from solid to liquid, and said base material of said thermal barrier liner is made of a thermoplastic material, that is elastic; and a closed cell substrate material incorporated in said base material, said closed cell substrate material having a plurality of cells defining voids, wherein said closed cell substrate material is gas permeable such that when said container is sealed and pressurized, gas within the container permeates through said composite thermal barrier liner and into said voids, and when said container is open thereby exposing the interior of the container to ambient pressure, the thermal barrier liner expands in response to a drop in relative pressure.

2. A container, as claimed in claim 1, wherein:

said liner is applied to an interior surface of said sidewall and said base.

* * * * *